US005472592A

United States Patent [19]

Lowery

[11] Patent Number: 5,472,592

[45] Date of Patent: Dec. 5, 1995

[54] ELECTROLYTIC PLATING APPARATUS AND METHOD

[75] Inventor: Kenneth J. Lowery, San Dimas, Calif.

[73] Assignee: American Plating Systems, Ontario, Calif.

[21] Appl. No.: 276,965

[22] Filed: Jul. 19, 1994

[51] Int. Cl.[6] ..... C25D 5/04; C25D 17/00; C25D 17/06

[52] U.S. Cl. ..... 205/137; 205/123; 205/143; 205/145; 205/148; 205/157; 205/162; 204/199; 204/212; 204/285; 204/286; 204/297 R

[58] Field of Search ..... 204/199, 285, 204/286, 297 R, 212; 205/137, 148, 157, 162, 143, 123, 145

[56] References Cited

U.S. PATENT DOCUMENTS

| | | | |
|---|---|---|---|
| 1,530,614 | 3/1925 | Pleister | 427/241 |
| 3,425,926 | 2/1969 | Hojyo | 204/213 |
| 3,594,227 | 7/1971 | Oswald | 117/229 |
| 3,598,083 | 8/1971 | Dort et al. | 118/48 |
| 3,608,519 | 9/1971 | Bean et al. | 118/48 |
| 3,633,537 | 1/1972 | Howe | 118/48 |
| 3,656,453 | 4/1972 | Tousimis | 118/48 |
| 3,663,273 | 5/1972 | Porter et al. | 117/107.1 |
| 3,675,624 | 7/1972 | Hunts et al. | 118/503 |
| 3,783,821 | 1/1974 | Dobson et al. | 118/48 |
| 3,798,056 | 3/1974 | Okinaka et al. | 117/113 |
| 3,840,986 | 10/1974 | Schmidtke et al. | 29/625 |
| 3,853,091 | 12/1974 | Christensen et al. | 118/49 |
| 3,983,838 | 10/1976 | Christensen | 118/49 |
| 4,124,411 | 11/1978 | Meuleman et al. | 136/89 |
| 4,182,669 | 1/1980 | Hojyo | 204/213 |
| 4,241,698 | 12/1980 | Vitale | 118/730 |
| 4,640,846 | 2/1987 | Kuo | 427/82 |
| 4,664,935 | 5/1987 | Strahl | 427/38 |
| 4,869,801 | 9/1989 | Helms et al. | 204/298 |
| 4,889,608 | 12/1989 | Eickmann | 204/212 |
| 5,015,352 | 5/1991 | Hashimoto et al. | 204/192.15 |
| 5,084,151 | 1/1992 | Vallana et al. | 204/192.11 |
| 5,151,133 | 9/1992 | Ohmine et al. | 118/725 |

FOREIGN PATENT DOCUMENTS

| | | | |
|---|---|---|---|
| 331265 | 9/1903 | France . | |
| 56-119799 | 9/1981 | Japan | C25D 17/00 |
| 107026 | 7/1982 | Japan . | |
| 205500 | 11/1984 | Japan . | |
| 1004499 | 1/1989 | Japan | C25D 21/10 |

*Primary Examiner*—John Niebling
*Assistant Examiner*—Edna Wong
*Attorney, Agent, or Firm*—Christensen O'Connor Johnson & Kindness

[57] ABSTRACT

An apparatus (10) for electrolytic plating of a substrate (44) includes a tank (14) in which a shaft (30) is centrally mounted for rotation about a first axis (28). The shaft carries an arm (40), on the distal end (112) of which is rotatably mounted a fixture wheel (44). The substrate to be plated is carried on the fixture wheel, which rides on an annular track (50) formed on the bottom of the tank around the shaft. A plurality of spaced pins (52) projecting upwardly from the track engage with a plurality of spaced recesses (56) formed about the perimeter (54) of the wheel, so that the wheel rotates about a second axis (64) while revolving around the first axis. The fixture carries a plurality of electrical contact members (46) that contact the substrate. Each contact member is separately supplied with current from a multichannel power supply (22). For each electrical contact member, the fixture includes a separate corresponding conductive brush (162), bushing (142) and lead (48) threaded through the arm and shaft to the corresponding channel of the power supply.

18 Claims, 5 Drawing Sheets

ELECTROLYTIC PLATING APPARATUS AND METHOD

TECHNICAL FIELD OF THE INVENTION

The present invention relates to equipment and methods for plating metals onto substrates within a plating solution bath, and particularly to plating of semiconductor circuits.

BACKGROUND OF THE INVENTION

The manufacture of integrated circuit semiconductor chips requires the plating of conductive leads about the periphery of the chip. Typically, a semiconductor rod is cut into disk-like wafers having a diameter ranging from 3 to 8 inches. The formation of integrated circuit patterns on the wafer to define a plurality of circuit "chips" involves the application of a photoresist layer to one surface of the wafer. Conductive leads are then formed about each of the circuits, typically by plating gold or copper onto the wafer.

The photoresist coating is applied to the wafer during formation so as to leave a narrow band of non-coated surface exposed about the perimeter of the circuit surface of the wafer. Conventional processes for forming the leads about these circuit chips include "bump plating" methods. The wafer is immersed in an electrolyte bath, such as, for example, a cyanide gold solution for plating gold leads. The wafer is contacted on the non-coated periphery, and current is applied across the wafer and an anode, also immersed in the electrolytic bath, such as a platinum anode for gold plating. Current is applied until the desired thickness of plating builds up on the wafer.

Traditional bump plating methods do not provide for uniformity in the plating thickness over the exposed surfaces of the wafer, however. The thickness of the plated leads may vary up to 200% across the width of the wafer. This results in a large rate of unacceptable chips being produced from each wafer.

SUMMARY OF THE INVENTION

The present invention provides an apparatus for use in plating of a substrate within an electrolytic bath. The apparatus includes a tank structure for containing an electrolyte and an anode. A shaft is rotatably mounted within the tank to rotate about a first axis. An arm is mounted on the shaft, and a fixture for receiving the substrate is rotatably mounted on the arm to rotate about a second axis, so that the substrate is both revolved about the first axis and rotated about the second axis. Electrical contact is maintained between the rotating substrate and a stationary power supply for plating.

In a further aspect of the present invention, the apparatus includes a plurality of electrical contacts on the fixture for contacting the substrate to be plated. Power is supplied from a multichannel power supply to the electrical contacts, so that each contact is separately supplied by a corresponding individual channel.

A process for electrolytic plating of substrates is disclosed and involves revolving a cathodic substrate having a surface defining a width around a first axis within an electrolytic bath, while rotating the substrate about a second axis. Current is applied across the substrate and an anode, also immersed within the electrolytic bath. Metal is plated onto the surface of the substrate to develop a thickness that is uniform within ±5% over the width of the substrate.

The present invention thus provides a method for plating integrated circuit chips and other articles with a highly uniform plating thickness. The apparatus and method are useful for plating not only circuit chips, but ceramic packages, thick or thin substrates, dimensional printed circuit boards, parts with "blind" recesses, and parts with through holes. Various metals, including gold, nickel, silver, tin, palladium, and copper can be plated onto substrates using the method.

In particular, for the plating of integrated circuit chips on a wafer, the percentage of acceptably plated integrated circuits on each wafer increases significantly due to the plating thickness being maintained with a ±5% deviation over the width of the wafer.

Problems with prior plating techniques that involve applying current to multiple electrical contacts on a substrate wafer are avoided. In such prior techniques, the current actually supplied to each individual contact may vary due to the strength of the contact made at a particular point. The present invention provides an apparatus and method making it possible to supply each of a plurality of electrical contacts with current from a corresponding separate power supply channel. The invention thus allows for monitoring for even distribution of current among the contacts. Lack of uniformity in current supply can be adjusted by repositioning the electrical contact or adjusting the power supply distribution amongst the channels.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
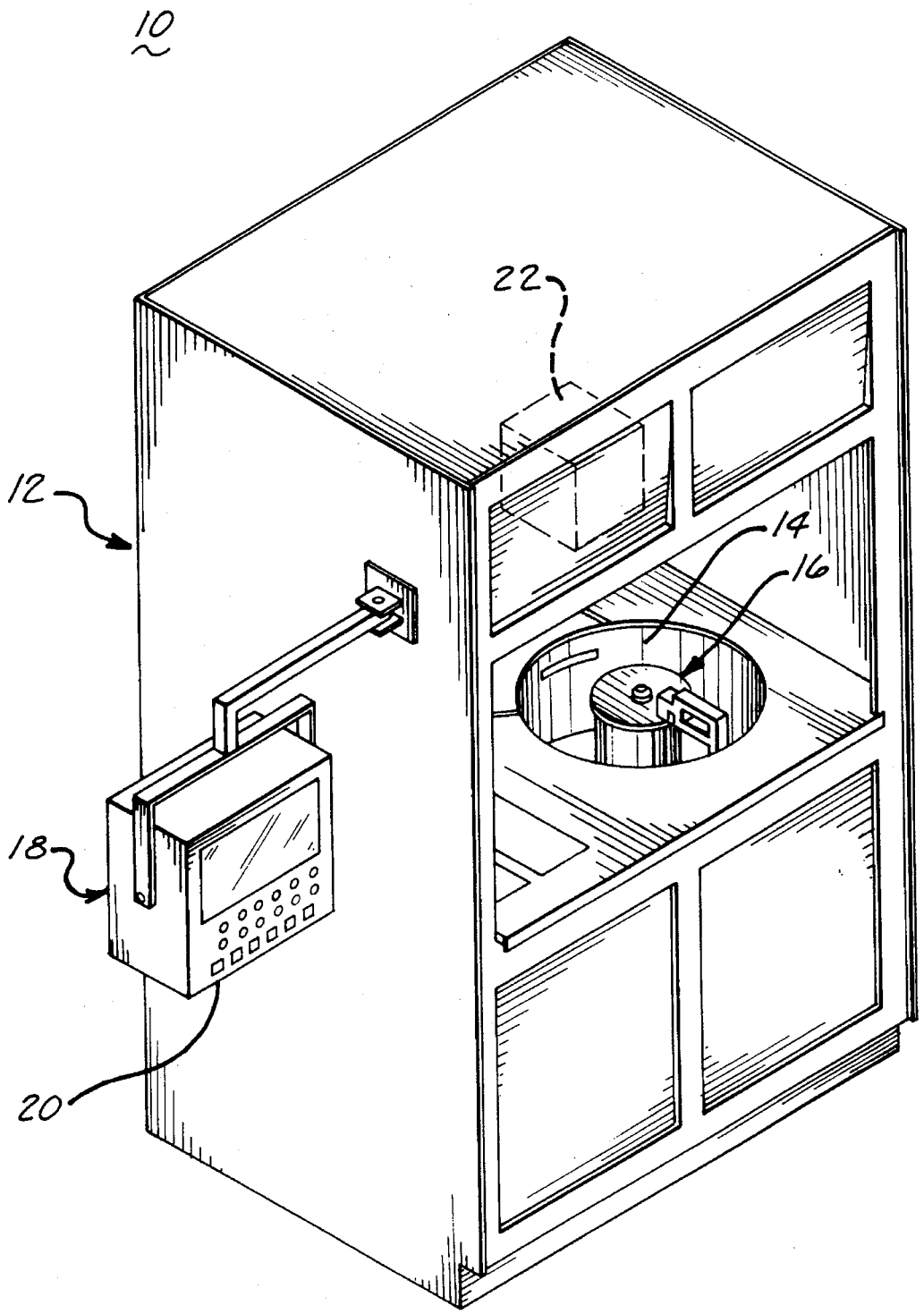
FIG. 1 provides a perspective view of a plating apparatus of the present invention.

A first preferred embodiment of a plating apparatus 10 constructed in accordance with the present invention is shown in FIG. 1. The apparatus includes a housing 12 that supports a plating tank 14 for containing an electrolyte solution, in which is mounted a rotary/reciprocating fixture assembly 16 that carries articles to be plated. A control console 18 mounted on the housing 12 includes a user interface 20 and control circuitry (not shown). The control circuitry controls operation of the rotary/reciprocating fixture assembly 16 and of a multichannel power supply 22, housed within the housing 12, that supplies current through the rotary/reciprocating fixture assembly 16 during plating.

Figure 2:
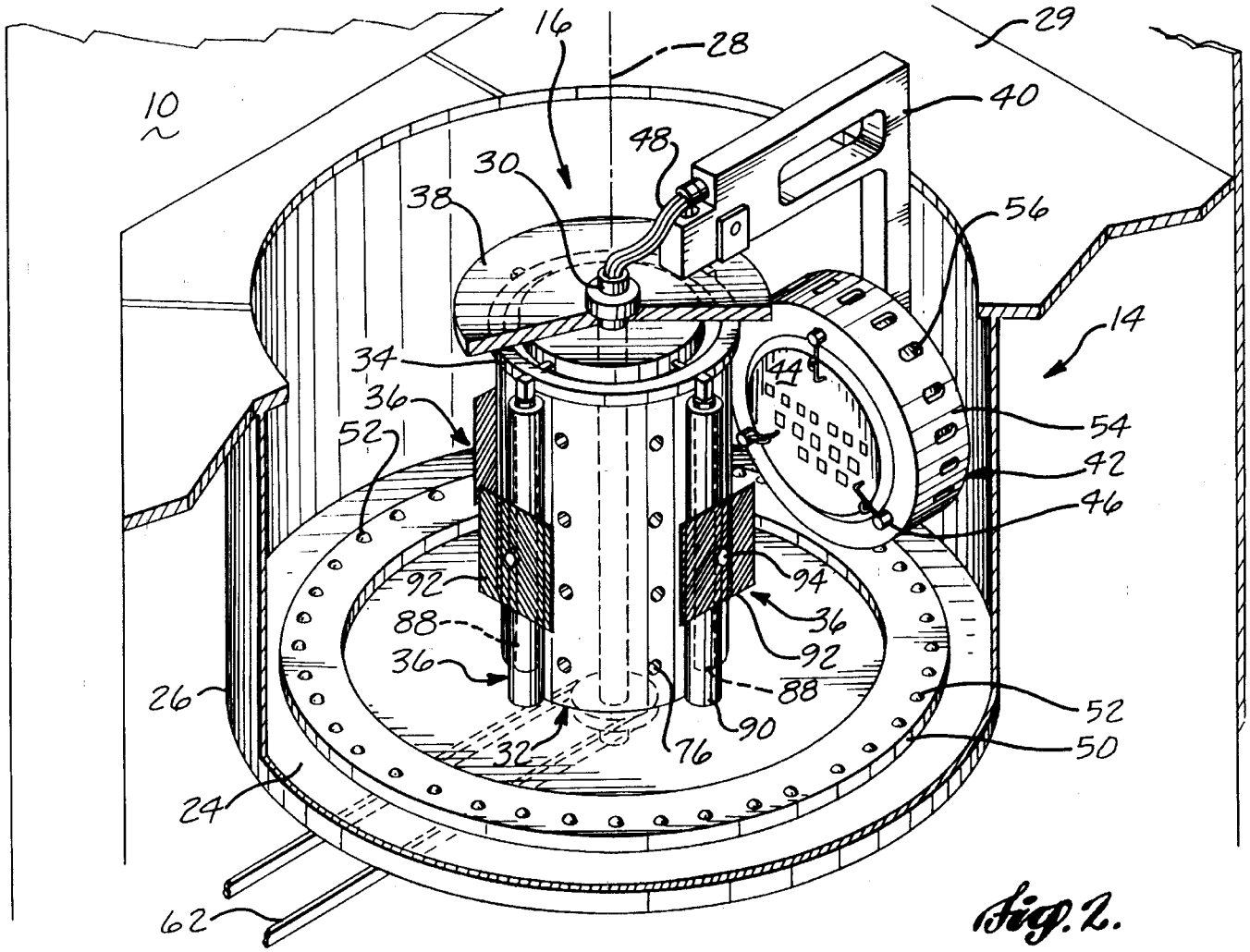
FIG. 2 provides a detailed perspective view of the electrolyte tank and rotary/reciprocating fixture assembly, with portions of the tank removed for clarity.

The tank 14 and rotary/reciprocating fixture assembly 16 are shown in greater detail in FIG. 2. The open topped tank 14 is cylindrical, having a bottom wall 24, a sidewall 26 and a central axis 28. The upper edge of the sidewall 26 is sealed about an opening formed in a support plate 29 of the housing 12. A drive shaft 30 is rotatably mounted within the tank 14 on the central axis 28, projecting orthogonally upward through the bottom wall 24. The drive shaft 30 is surrounded by an annular electrolyte reservoir assembly 32 that sparges recirculating electrolyte solution through the tank 14 during plating. The reservoir assembly 32 also supports an anode support ring 34 from which extend downwardly a plurality of anode assemblies 36.

A fixture mounting plate 38 is non-rotatably secured to the upper end of the drive shaft 30, above the reservoir assembly 32. A fixture arm 40 is connected to the fixture mounting plate 38, and projects radially and then downwardly into the interior of the tank 14. A fixture wheel 42 is rotatably secured to the distal end of the fixture arm 40. The fixture wheel 42 carries the article to be plated, such as the semiconductor wafer 44 illustrated, which is mounted by three spring loaded electrical contacts 46. The electrical contacts 46 both retain the semiconductor wafer 44 and carry current from corresponding channels of the multichannel power supply 22 through corresponding electrical leads 48 to the semiconductor wafer 44.

An annular track 50 is secured within the tank 14 on the upper surface of the bottom wall 24, and is centered about the central axis 28. A series of pins 52 are secured within longitudinal passages in the track 50 and project upwardly therefrom to create a periodic series of protuberances around the track 50. The perimeter 54 of the fixture wheel 42 rests on the track 50. A series of longitudinally oriented slots 56 is formed about the perimeter 54 of the fixture wheel 42, and are dimensioned and spaced to engage with the tops of the pins 52 of the track 50.

The drive shaft 30 is rotated by a motor 58 (FIG. 3) mounted within the housing 12 below the bottom wall 24 of the tank 14. A drive pulley 59 on the motor 58 is connected to a driven pulley 60 secured on the projecting bottom end of the drive shaft 30 by a belt 62. The drive shaft 30 is rotated in a reciprocating fashion about the central axis 28, and carries with it the fixture mounting plate 38, fixture arm 40, fixture wheel 42, and thus the semiconductor wafer 44. As the semiconductor wafer 44 revolves in a reciprocating manner about the central axis 28, the fixture wheel 42, and thus the semiconductor wafer 44, rotate about the rotary axis 64 (FIG. 3) of the fixture wheel 42. The cathodic semiconductor wafer 44 thus both revolves and rotates relative to the anode assemblies 36 during plating to enhance the uniformity of plated coated thickness across the face of the semiconductor wafer 44.

Figure 3:
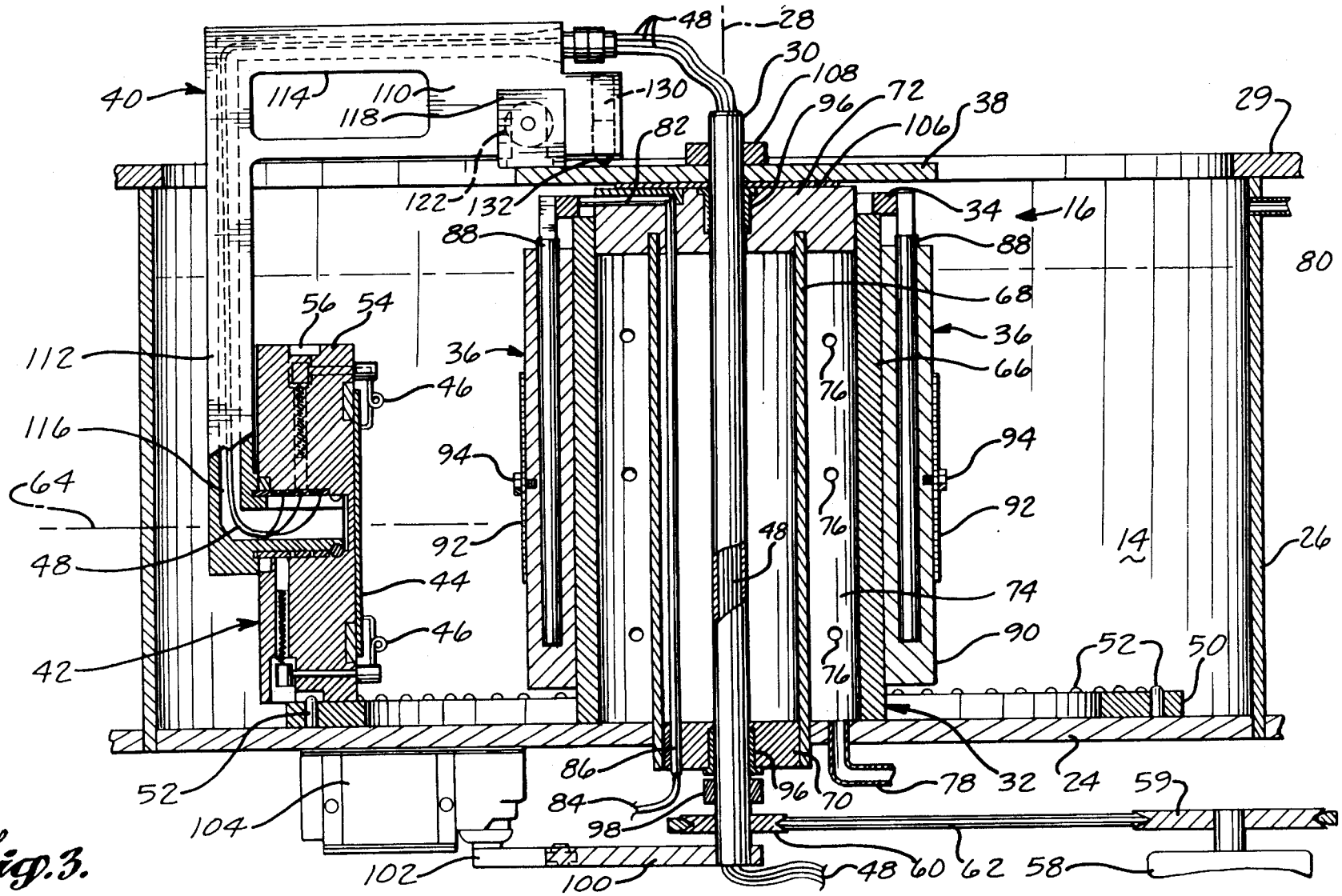
FIG. 3 provides a cross-sectional view of the rotary/reciprocating fixture assembly and tank of FIG. 2, taken substantially along a plane defined by the longitudinal axis of the structure and tank.

Referring to FIG. 3, the construction of the apparatus 10 will now be described in greater detail, beginning with the reservoir assembly 32. The reservoir assembly 32 is constructed from an outer tube 66 and an inner tube 68, which are coaxially installed and centered on the central axis 28. The tank 14 and structural components contained therein are constructed from a metal or polymeric material that is resistant to the plating solutions being utilized, such as polypropylene, TEFLON™ or stainless steel. The inner tube 68 passes upwardly through and is joined to an aperture in the bottom wall 24 of the tank 14. A round bottom plate 70 is received within and seals the interior of the bottom end of the inner tube 68. The upper end of the inner tube 68 extends nearly the full height of the tank 14. The upper edge of the inner tube 68 is received within and sealed to an annular groove formed in the bottom surface of a round cap plate 72.

The outer tube 66 is larger than the inner tube 68, and has an internal diameter sized to slide over the cap plate 72. The outer tube 66 extends from the bottom wall 24 of the tank 14 up to and surrounding the cap plate 72. An annular reservoir space 74 is defined between the inner tube 68 and the outer tube 66. A plurality of vertical arrays of apertures 76 are formed at periodic radially spaced intervals through the outer tube 66. During plating with the apparatus 10, the plating solution, i.e., electrolyte, is supplied to the annular reservoir space 74 through a supply tube 78. The solution flows from the reservoir space 74, and is sparged through the apertures 76 into the interior of the tank 14. The apertures 76 are arranged in the outer tube 66 such that the solution is substantially evenly dispersed at all depths and radially locations within the tank 14. Solution overflows the tank from an outlet 80 near the top of the tank, flows to a sump pump (not shown), and is re-supplied to the tank 14 via the supply tube 78. Solution is thus recirculated throughout the tank 14 during use, ensuring that the anode assemblies 36 and wafer 44 are exposed to fresh electrolyte, and so that local deficiencies within the tank 14 are avoided.

The reservoir assembly 32 also provides support for the anode support ring 34. The anode support ting 34 rests on top of the upper edge of the outer tube 66. The anode support ting 34 is constructed from a conductive material such as copper or stainless steel. The anode support ring 34 is electrically connected to one side of the plating power supply 22. A conductor rod 82 is connected to a point on the inner diameter of the annular anode support ring 34, and is inserted radially into the cap plate 72 to a point extending above the interior of the inner tube 68. The inner end of the conductor rod 82 is connected to a second conductor rod 86. The conductor rod 86 extends longitudinally from the cap plate 72, down through the interior of the inner tube 68, exiting through the bottom plate 70. An electrical lead 84 is connected from the bottom end of the conductor rod 86 to the power supply 22. In this manner power is supplied to the anode support ring 34 from the multichannel power supply 22.

The anode support ring 34 supports at least one, and preferably a plurality of anode assemblies 36. In the preferred embodiment of the apparatus 10 illustrated in FIGS. 2 and 3, four anode assemblies 36 are arranged radially around the reservoir assembly 32. Each anode assembly 36 includes a conductor rod 88 that is secured at its upper end to the outer diameter of the anode support ring 34, and that depends downwardly a majority of the depth of the tank 14. The conductor rod 88 is constructed from a conductive material such as stainless steel or copper, and is sheathed in an insulative sleeve 90, such as a polyvinyl chloride sleeve. The conductor rod 88 and insulative sleeve 90 are preferably mutually threaded for assembly.

Each anode assembly 36 includes an anode 92 of the appropriate material for the plating process at hand. For example, to apply gold plating to the semiconductor wafer 44, a suitable anode 92 is a platinum plated square section of metallic mesh, which is utilized with an electrolyte solution such as a cyanide gold solution. The anode 92 is mounted to the anode assembly 36 and placed in electrical contact with the power supply 22 by a bolt 94. The bolt 94 is inserted through the center of the anode 92, through an aperture in the insulative sleeve 90, and is threaded into the conductor rod 88. A current path thus exists from the power supply 22, through the electrical lead 84 to the conductor rod 82, the anode support ting 34, the conductor rod 88, the bolt 94 and to the anode 92. While a solid conductor rod 88 has been described for mounting the anodes 92, it should be apparent that other constructions are possible, such as the use of a hollow mounting tube through which electrical leads are threaded.

Each anode 92 is positioned at a height within the tank 14 approximately equal to the positioning of the semiconductor wafer 44 when mounted on the fixture wheel 42. As the fixture arm 40 reciprocates, the fixture wheel 42 sequentially passes each of the anodes 92, such that there is always an anode 92 in close proximity to the semiconductor wafer 44.

Referring still to FIG. 3, the drive shaft 30 is journalled within upper and lower beatings 96 within the bottom plate 70 and cap plate 72 on the central axis 28. A shaft collar 98 is mounted on the bottom end of the drive shaft 30, which extends below the bottom plate 70. The driven pulley 60 is mounted on the bottom end of the drive shaft 30 below the shaft collar 98. One end of an elongate actuator 100 is secured on the bottom end of the drive shaft 30 below the driven pulley 60. The other end of the actuator 100 projects radially outward from the drive shaft 30.

The radial distal end of the actuator 100 aligns with a switch arm 102 so that each approximate 360 degree rotation of the drive shaft 30 causes the actuator 100 to move the switch arm 102. The switch ann 102 triggers a switch 104, which operates to reverse direction of the motor 58 upon each approximate 360 degree (i.e., 330° –350°) rotation of the drive shaft 30. This causes the drive shaft 30, and thus the fixture arm 40 and fixture wheel 42, to automatically reciprocate, first rotating clockwise approximately 360 degrees about the central axis 28, followed by immediate reversal and rotation approximately 360 degrees counter-clockwise about the central axis 28, and so forth. The speed of rotation of the drive shaft 30 is selected for a particular process, and typically is between 1 and 13 revolutions per minute. The preferred operation speed is 3 revolutions per minute.

A low friction wear disc 106 is slid over the upper end of the drive shaft 30, and rests on top of the cap plate 72. The wear disc 106 is sandwiched between the cap plate 72 and the fixture mounting plate 38, and is constructed from a material such as ultra high molecular weight polyethylene, TEFLON™ fluorocarbon, or nylon that provides a smooth, low friction surface for the fixture mounting plate 38 to travel on as it rotates with the shaft 30. The fixture mounting plate 38 is retained on the shaft 30 by a nut 108. The interior of the central shaft 30 is hollow, and the electrical leads 48 that supply power to the fixture wheel 42 are threaded through the interior of the central shaft 30.

The fixture arm 40 shall now be described with reference to FIGS. 3 and 4. The apparatus 10 has been illustrated and described as including one fixture arm 40 and fixture wheel 42. The use of a single fixture arm and fixture wheel has been illustrated for clarity and because it is a suitable configuration for the apparatus 10. However, it is typically preferable to utilize a plurality of fixture arms 40 and fixture wheels 42, in order to enable the simultaneous plating of multiple semiconductor wafers 44 or other substrates.. When multiple fixture arms 40 and fixture wheels 42 are utilized, they are spaced evenly in radial disposition about the drive shaft 30. The use of up to eight fixture arms 40 and fixture wheels 42 has been found suitable, with a typical number of fixture arms 40 and fixture wheels 42 utilized being four.

The fixture arm 40 is detachably mounted to the fixture mounting plate 38 in order to provide for easy removal of the entire fixture arm 40, fixture wheel 42 and semiconductor wafer 44. This provides for installation and removal of the semiconductor wafer outside of the tank 14. The fixture arm 40 has an overall 90 degree angled configuration, having a first leg 110 and a second leg 112. When mounted in the tank 14, the first leg 110 is horizontally disposed and substantially perpendicular to the central axis 28. The first leg 110 extends radially outward from the reservoir assembly 32. The second leg 112 depends downward from the first leg 110, and is oriented substantially parallel to the central axis 28. A hand-hold aperture 114 is formed through the first leg 110 to allow for gripping and removal of the fixture arm 40. The arm 40 is hollow, including an elongate passage 116 that is formed through both the first leg 110 and second leg 112 to allow for passage of the electric leads 48 through the interior of the fixture arm 40.

Figure 4:
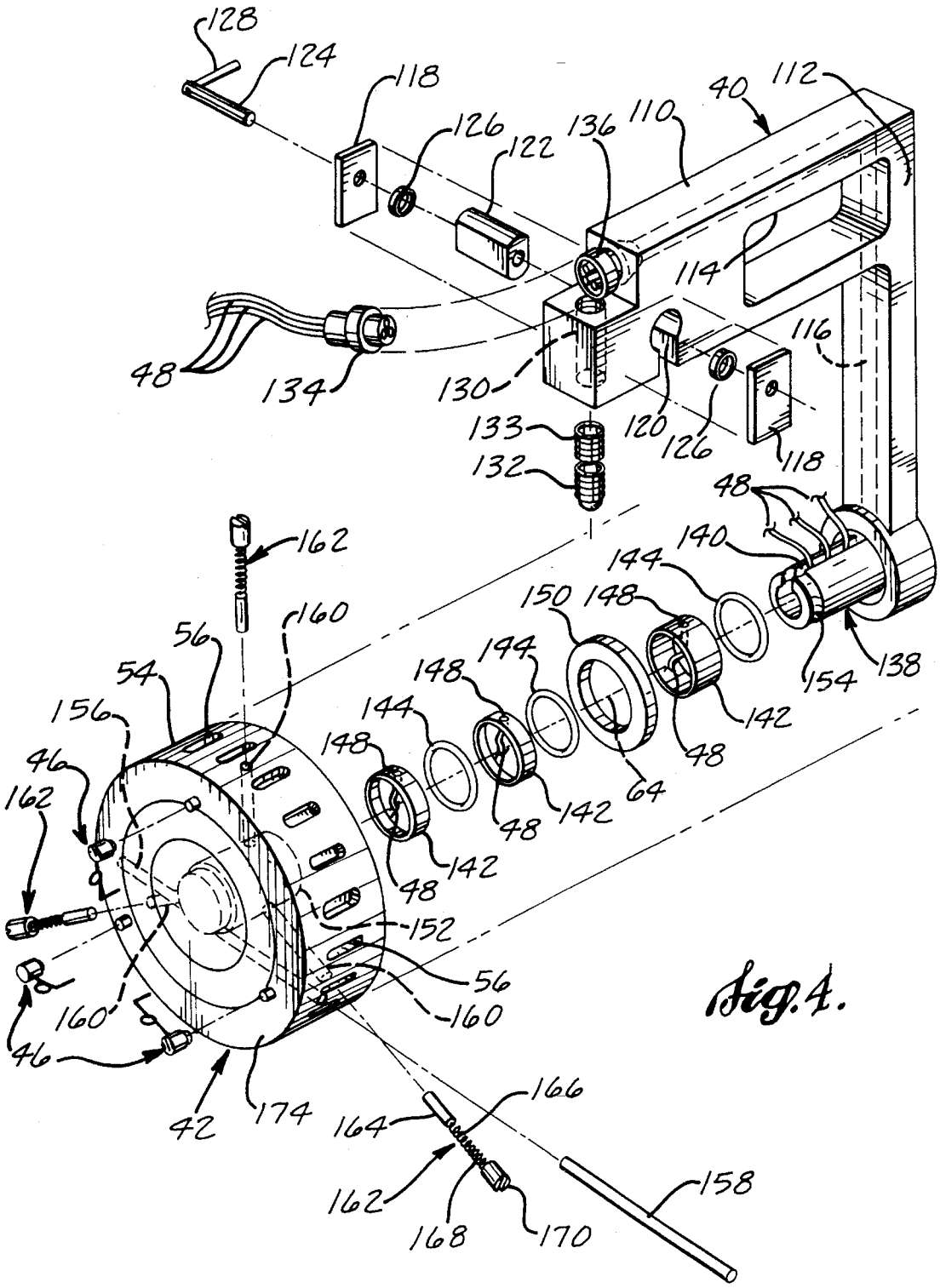
FIG. 4 provides a perspective exploded view of the fixture arm and wheel of the apparatus of FIG. 1.

Referring to FIG. 4, the first leg 110 of the fixture arm 40 is mounted between two flanges 118, a short distance from the radially innermost end of the first leg 110, to the fixture mounting plate 38. The flanges 118 are secured in spaced parallel disposition and project upwardly from the fixture mounting plate 38. A keyhole aperture 120 is formed transversely through the first leg 110 of the fixture arm 40 for mounting to the flanges 118. The keyhole aperture 120 is configured as a round transverse passage formed crosswise through the first leg 110, and which extends into a narrower slot to the bottom edge of the first leg 110. A retaining shaft 122 is received within the keyhole aperture 120 to secure the fixture arm 40 to the fixture mounting plate 38. The retaining shaft 122 is configured as a cylinder that is flattened on two opposing sides.

The retaining shaft 122 is non-rotatably secured on a pin 124 between the flanges 118. The pin 124 passes through aligned apertures formed in the flanges 118, the retaining shaft 122, and beatings 126 which are mounted between the ends of the retaining shaft 122 and the flanges 118. The pin 124 and thus the retaining shaft 122 can be rotated by pressing on a lever 128 that projects radially from one end of the pin 124. When the retaining shaft 122 is positioned as it is shown in FIG. 4, with the flat sides of the shaft vertically disposed, the shaft 122 can be inserted from the bottom edge of the first leg 110 of the fixture arm 40 into the keyhole aperture 120. When the pin 124 and retaining shaft 122 are then rotated so that the flat sides of the shaft 122 are horizontally positioned, the retaining shaft 122 no longer fits through the slotted portion of the keyhole aperture 120, and the fixture arm 40 is locked onto the fixture mounting plate 38. It should be readily apparent to one of skill in the art that an alternate selective locking mechanism rather than the retaining shaft 122 and keyhole aperture 120 could be utilized, such as a spring loaded retention pin.

The fixture arm 40 is also provided with an adjustment mechanism that enables the arm to pivot on the retaining shaft 122 to adjust the loading of the fixture wheel 42 against the track 50. A threaded passage 130 is formed vertically through the radially innermost end of the first leg 110 of the fixture arm 40. The passage 130 receives a stacked spring-loaded ball plunger 132 and a set screw 133. The ball plunger 132 projects from the bottom of the threaded passage 130 and bears against the fixture mounting plate 38. The position of the ball plunger 132 can be adjusted for the desired degree of loading of the fixture wheel 42 onto the track 50 by tightening the set screw 133 against the ball plunger 132. This adjustment can be made if, after some usage and wear of the apparatus 10, it is found that the fixture wheel 42 begins to slip relative to the track 50.

The electrical leads 48 from the multichannel power supply 22 are preferably fitted with a plug 134 that mates with a socket 136 that is mounted within the opening to the passage 116 within the first leg 110 of the fixture arm 40. The electrical leads 48 may be bundled for ease of threading through the passage 116.

Figure 5:
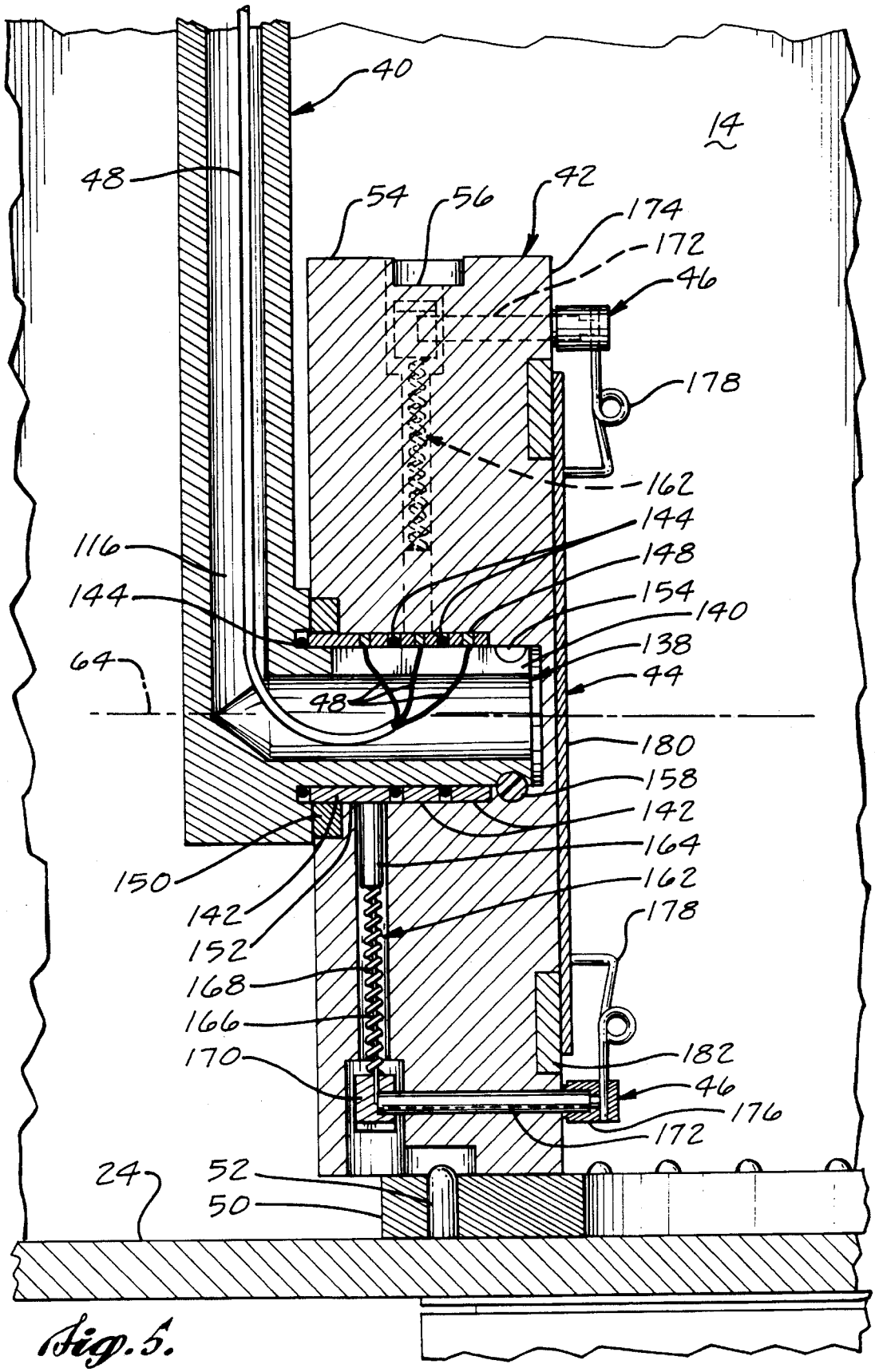
FIG. 5 provides a detailed cross-sectional view of the fixture wheel mounted on the distal end of the fixture arm taken substantially along a plan aligned with the central axis of the fixture wheel.

Attention is now directed to FIGS. 4 and 5 to describe the mounting of the fixture wheel 42 onto the fixture arm 40. The second leg 112 of the fixture arm 40 includes a shaft portion 138 that projects perpendicularly from the lower end of the second leg 112, toward the reservoir assembly 32. The shaft portion 138 is cylindrically configured and defines the rotary axis 64 of the fixture wheel 42. All annular components of the fixture wheel 42 and the shaft portion 138 are coaxially aligned on the rotary axis 64. The shaft portion 138 includes a longitudinal slot 140 which provides for exit of the electrical leads 48.

The fixture arm 40, shaft 138 and the fixture wheel 42 are constructed from a non-conductive material, such as ultra high molecular weight polyethylene. A conductive path is formed from the electrical leads 48 to the electrical contacts 46. This path includes three tubular conductive contact bushings 142 that are slid onto the shaft portion 138 of the fixture arm 40. The contact bushings 142 are separated from each other by three annular non-conductive o-rings 144. There are thus three conductive bands formed around the shaft portion 138 that are isolated electrically from each other. A radial passage 148 is formed in each of the conductive contact bushings 142. An end of a corresponding electrical lead 48 is soldered into each of the passages 148 to connect each separate electrical lead 48 to a corresponding conductive contact bushing 142.

When the contact bushings 142 are slid onto the shaft portion 138 of the fixture arm 40, the leads 48 pass through the slot 140 in the fixture arm 40. Prior to placement of the fixture wheel 42, an annular seal 150 is slid over the contact bushings 142 and up against the second leg 112 of the fixture arm 40, to provide a fluid tight seal between the fixture wheel 42 and the fixture arm 40.

The fixture wheel 42 includes a central cylindrical recess 152 that rotatably receives the shalt portion 138 of the fixture arm 40. An annular groove 154 is formed around the distal end of the shalt portion 138 of the fixture arm 40. A tangential bore 156 is formed into the fixture wheel 42 and aligns with the groove 154 when the fixture wheel 42 is fully inserted onto the shaft portion 138. A low friction locking rod 158, which may be suitably constructed from a fluorinated hydrocarbon polymer, is inserted into the bore 156 and thus passes tangentially into the groove 154. This locking rod 158 travels about the groove 154 as the fixture wheel 42 rotates on the shaft portion 138, and prevents the fixture wheel 42 from coming loose from the shalt portion 138.

A separate conductive path is provided from each conductive contact bushing 142 to a corresponding electrical contact 46. Three radial passages 160 are formed into the perimeter 54 of the fixture wheel 42 and extend to the internal recess 152 of the fixture wheel 42. The radial passages 160 are staggered longitudinally along the longitudinal width of the fixture wheel 42, such that each radial passage 160 aligns with a corresponding one of the conductive contact bushings 142 when the fixture wheel 42 is installed on the shalt portion 138.

An elongate brush assembly 162 is installed into each radial passage 160. Each brush assembly includes a conductive contact tip 164 connected by an internal lead 166 and a coil spring 168 to a plug 170. The contact tip 164 is constructed from a relatively soft conductive material, such as silver carbide, and rides on the corresponding contact bushing 142 as the fixture wheel 42 rotates. Current is conducted from the contact bushing 142 to the contact tip 164, through the lead 166 to the plug 170. The coil spring 168 biases the contact tip 164 against the contact bushing 142, so that electrical contact is maintained despite wear of the contact tip 164.

Each electrical contact 46 is connected to a corresponding brush assembly 162 by a conductive rod 172 that is inserted longitudinally into the front face 174 of the fixture wheel 42. The radially distal end of the lead 166 of the brush assembly 162 is secured to one end of the conductive rod 172, and the other end of the conductive rod 172 is received within a body 176 of the electrical contact 46. (FIG. 5). Each electrical contact 46 includes a conductive spring contact 178 that has a first end inserted radially into the body 176 and that is threaded onto the conductive rod 172. The spring contact 178 twists into a loop for tension and then forms a 90 degree angled portion, the tip of which is biased against the outer surface 180 of the wafer 44.

Conventional semiconductor wafers 44 are thin discs, typically from 3 to 8 inches in diameter. The semiconductor is conventionally coated with a photoresist material except for a narrow band around the perimeter of the outer surface 180 of the semiconductor wafer 44. The semiconductor wafer 44 is positioned over the front face 174 of the fixture wheel 42. Because it is not desired to have plating form on the opposite side of the semiconductor wafer 44, a gasket is provided between the wafer 44 and the front face 174 of the fixture wheel 42. In the embodiment of FIG. 5, a flat annular gasket 182 is received within an annular recess formed in the front face 174 of the fixture wheel 42 to seal the back face of the wafer 44. It should be apparent to those of skill in the art that a solid sheet gasket or another type of seal such as an o-ring seal could instead be utilized.

The electrical contacts 46 are turned after placement of the wafer 44 so that the tips of the spring contacts 178 contact a non-photoresist coated point of the semiconductor wafer 44. A current path is thus provided from the electrical leads 48 through the conductive bushings 142 to the brush assemblies 162, electrical contacts 46 and to the wafer 44.

In the preferred embodiment illustrated, three electrical contacts 46 are carded on the fixture wheel 42. The use of three contacts is found suitable to evenly distribute current to the semiconductor wafer 44. However, it should be readily apparent that differing numbers of electrical contacts could be utilized as desired. Further, the term electrical contact as used herein is intended to include not only the spring loaded electrical contacts 46 illustrated, but other electrical contacts. For example, an annular holding ring with segmented electrical portions could be utilized to retain and contact the wafer 44.

A critical aspect of the present invention is the multichannel delivery of current to the wafer 44 via separate current delivery circuits. One side of the multichannel power supply 22 is connected to the anodes 92, as previously described. The other side of the multichannel power supply is connected to the wafer 44 which serves as the cathode, and current passes from the anodes 92 to the wafer 44 through the electrolyte solution. The power supply 22 is a multichannel power supply, which as used herein is intended to mean either a power supply with multiple channels or collectively to a plurality of single channel power supplies.

The distribution of current delivered from the multichannel power supply 22 may be adjusted by adjusting the channels relative to each other. A separate individual current circuit is provided from each channel of the power supply 22 to a corresponding electrical contact 46. This current path is provided through the corresponding separate leads 48 passing through the fixture arm 40 to the corresponding electrically isolated conductive contact bushings 142. The individual paths are then continued through the corresponding individual brush assemblies 162 to the corresponding electrical contacts 46.

During plating, the current delivery through each channel of the power supply 22 can be monitored via the control console 18. If power supply to the individual contacts 46 is uneven, the electrical contacts 46 can be manually adjusted to correct for any poor contact being made with the wafer 44, by repositioning the spring contacts 178. If an uneven power distribution is still found, the multichannel power supply 22 itself can be adjusted to correct the distribution. This prevents the thickness of the plated coating being formed on the semiconductor wafer 44 from building up more heavily in the vicinity of one electrical contact 46 relative to another electrical contact 46.

As previously discussed, the perimeter 54 of the fixture wheel 42 rides on the track 50. The tips of the pins 52, which are preferably constructed of a polyethylene polymer, are received within corresponding slots 56 formed in the perimeter 54 of the fixture wheel 42 as the fixture wheel 42 rotates on the track 50. The positive mechanical engagement of the pins 52 and the slots 56 forces the fixture wheel 42 to continuously turn about the rotary axis 64 without slippage during revolution of the fixture wheel 42 around the central axis 28. The slippage that could occur with two smooth low friction surfaces is thus avoided. This mechanical engagement of the fixture wheel 42 and track 50 could alternately be otherwise obtained, such as by providing gear teeth on the fixture wheel which mesh with corresponding teeth on the track 50. The result is that the fixture wheel 44 must necessarily rotate about the rotary axis 64 in direct proportion to the extent of rotation of the shaft 30 about the central axis 28.

The rotary axis 64 of the fixture wheel 42 is oriented perpendicularly to the central axis 28 of a tank 14. Any individual point on the wafer 44 being plated thus simultaneously revolves in reciprocal fashion around the central axis 28 while rotating about the rotary axis 64. All points on the outer surface 180 of the wafer 44 are thus exposed equally to the anodes 92. This multi-axis rotation provides for an even degree of plating across the wafer 44. This uniformity of plating could be lost if the fixture wheel 42 were to slip relative to the track 50, which is avoided due to the positive drive engagement of the pins 52 and slots 56. Further, the uniformity of plating thickness is also greatly affected if the distribution of current is not uniform across the wafer 44, which is avoided by the provision of multichannel power paths.

Conventional bump plating methods result in wafers 44 having plating thicknesses varying as much as 200% across the width of the wafer. The multi-axis rotary/reciprocating revolving motion of the wafer provided by the present invention yields a plating uniformity of 35 10% deviation across the width of the wafer. By including the independently adjustable electrical contact circuits of the present invention and the positive drive of the fixture wheel 42 and track 50 provided by the mating pins 52 and slots 56, the present invention provides for a deviation in plating thickness of less than or equal to ±5% for 5 to 8 inch diameter wafers, and of less than or equal to ±3% for 3 to 4 inch diameter wafers. Preferably, plating uniformity of at least ±1 to 2 percent deviation across the width of a 3 to 4 inch wafer is obtained.

These low deviations have been measured when gold plating is applied using the present invention to a thickness of 8 to 35 microns through application of current of 15 to 100 milliamps for a period of time of 20 minutes to 1 hour and 50 minutes. These low deviations have also been obtained from plating copper in accordance with the present invention to a thickness of approximately 3.75 microns by application of 300 milliiamps of power. In general, plating thicknesses obtained with the present invention are found to vary no more than 0.25 microns over a distance of 1,000 microns across the width of a wafer being plated.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An apparatus for use in plating a substrate within an electrolytic bath, comprising:

a tank structure for containing the electrolytic bath;

a shaft rotatably mounted in the tank to rotate about a first axis;

an arm mounted on the shaft;

a fixture for receiving the substrate, the fixture being rotatably mounted on the arm to rotate about a second axis, wherein the second axis is oriented perpendicular to the first axis;

means for positively driving rotation of the fixture about the second axis when the shaft rotates about the first axis, so that rotation of the fixture and the substrate about the second axis necessarily results in direct proportion from rotation of the shaft about the first axis; and means for maintaining electrical contact between the rotating substrate and a stationary power supply.

2. An apparatus for use in plating a substrate within an electrolytic bath, comprising:

a tank structure for containing the electrolytic bath;

a shaft rotatably mounted in the tank to rotate about a first axis;

an arm mounted on the shaft;

a fixture for receiving the substrate, the fixture being rotatably mounted on the arm to rotate about a second axis;

means for positively driving rotation of the fixture about the second axis when the shaft rotates about the first axis, so that rotation of the fixture and the substrate about the second axis necessarily results in direct proportion from rotation of the shaft about the first axis, wherein the fixture has a perimeter that defines a contoured engaging surface and the means for positively driving rotation of the fixture comprises an annular track defined by the tank structure about the first axis, the track defining a correspondingly contoured mating surface, the perimeter of the fixture riding on the track when the shaft rotates about the first axis, the engaging surface of the fixture engaging the mating surface of the track to ensure that the fixture rotates about the second axis and does not slip relative to the track; and means for maintaining electrical contact between the rotating substrate and a stationary power supply.

3. The apparatus of claim 2, wherein one of the engaging surface or the mating surface defines a plurality of spaced protuberances and the other of the engaging surface or the mating surfaces defines a plurality of correspondingly spaced recesses that engage with the protuberances.

4. An apparatus for use in plating a substrate within an electrolytic bath, comprising:

a tank structure for containing the electrolytic bath;

a shaft rotatably mounted in the tank to rotate about a first axis;

an arm mounted on the shaft;

a fixture for receiving the substrate, the fixture being rotatably mounted on the arm to rotate about a second axis;

means for positively driving rotation of the fixture about the second axis when the shaft rotates about the first axis, so that rotation of the fixture and the substrate about the second axis necessarily results in direct proportion from rotation of the shaft about the first axis; and means for maintaining electrical contact between the rotating substrate and a stationary power supply, wherein the means for maintaining electrical contact includes a plurality of electrical contact members mounted on the fixture to contact the substrate at spaced locations.

5. The apparatus of claim 4, wherein the means for maintaining electrical contact further comprises a plurality of individual electrical power supply circuits, each circuit placing a corresponding electrical contact member in contact with a corresponding source of power.

6. The apparatus of claim 5, further comprising a multichannel power supply, wherein separate channels of the multichannel power supply are connected to corresponding power supply circuits.

7. The apparatus of claim 6, further comprising means for monitoring the distribution of power among the plurality of electrical contact members.

8. The apparatus of claim 1, further comprising a stationary anode disposed within the tank structure for immersion in the electrolytic bath and connectable to the power supply.

9. An apparatus for use in plating a substrate within an electrolytic bath, comprising:

a tank structure for containing the electrolytic bath;

a shaft rotatably mounted in the tank to rotate about a first axis;

an arm mounted on the shaft;

a fixture for receiving the substrate, the fixture being rotatably mounted on the arm to rotate about a second axis;

means for positively driving rotation of the fixture about the second axis when the shaft rotates about the first axis, so that rotation of the fixture and the substrate about the second axis necessarily results in direct proportion from rotation of the shaft about the first axis; and means for maintaining electrical contact between the rotating substrate and a stationary power supply, further comprising a stationary anode disposed within the tank structure for immersion in the electrolytic bath and connectable to the power supply, wherein the stationary anode is disposed proximate the shaft, so that the fixture revolves about the anode during plating.

10. The apparatus of claim 9, further comprising a plurality of anodes spaced about the shaft.

11. An apparatus for use in plating a substrate within an electrolytic bath, comprising:

a tank structure for containing the electrolytic bath;

a shaft rotatably mounted in the tank to rotate about a first axis;

an arm mounted on the shaft;

a fixture for receiving the substrate, the fixture being rotatably mounted on the arm to rotate about a second axis, wherein the arm is detachably connected to the shaft to allow removal of the arm and fixture from the tank structure for installation and removal of the substrate;

means for positively driving rotation of the fixture about the second axis when the shaft rotates about the first axis, so that rotation of the fixture and the substrate about the second axis necessarily results in direct proportion from rotation of the shaft about the first axis; and means for maintaining electrical contact between the rotating substrate and a stationary power supply.

12. The apparatus of claim 1, further comprising means for circulating an electrolyte solution through the tank structure to expose the rotating and revolving substrate to a substantially uniform concentration of electrolyte during plating.

13. An apparatus for use in plating a substrate within an electrolytic bath, comprising:

a tank structure for containing the electrolytic bath;

a shaft rotatably mounted in the tank to rotate about a first axis;

an arm mounted on the shaft;

a fixture for receiving the substrate, the fixture being rotatably mounted on the arm to rotate about a second axis;

means for positively driving rotation of the fixture about the second axis when the shaft rotates about the first axis, so that rotation of the fixture and the substrate about the second axis necessarily results in direct proportion from rotation of the shaft about the first axis; and means for maintaining electrical contact between the rotating substrate and a stationary power supply further comprising means for circulating an electrolyte solution through the tank structure to expose the rotating and revolving substrate to a substantially uniform concentration of electrolyte during plating, wherein the means for circulating electrolytic solution comprises:

an annular electrolytic solution reservoir formed about the shaft; and means for discharging electrolytic solution from multiple outlets spaced longitudinally along the reservoir.

14. An apparatus for use in electrolytic plating of a substrate, comprising:

a tank structure for containing an electrolytic solution;

a fixture for receiving the substrate for rotation within the tank structure during plating;

a plurality of electrical contact members carried on the fixture for contacting the substrate at a plurality of spaced locations; and means for supplying power from a multichannel power supply to the electrical contact members, wherein each electrical contact member is separately supplied by a corresponding power supply channel.

15. A process for electrolytic plating of a substrate, comprising:

revolving a cathodic substrate having a surface defining a width around a first axis within an electrolytic bath, while also rotating the cathodic substrate about a second axis, wherein the second axis is oriented perpendicular to the first axis;

applying current across the cathodic substrate and an anode; and plating metal onto the surface of the substrate to develop a uniform plating thickness varying no more than ±5% deviation over the width of the surface.

16. The process of claim 15, wherein the step of revolving and rotating comprises:

rotatably mounting a substrate fixture on a radially distant end of an arm connected to a shaft that rotates about a first axis;

rotating the shaft to revolve the fixture about the first axis; and rotating the fixture about the second axis while the fixture revolves about the first axis by engaging a perimeter of the fixture with an annular track formed about the shaft.

17. The process of claim 15, wherein applying current comprises separately supplying current from a plurality of channels of a multichannel power supply to a corresponding plurality of electrical contact points defined on the substrate.

18. The process of claim 15, wherein the thickness of plating is maintained to a uniformity of ±43% deviation over the width of the surface.

* * * * *

UNITED STATES PATENT AND TRADEMARK OFFICE

CERTIFICATE OF CORRECTION

PATENT NO. : 5,472,592

DATED : December 5, 1995

INVENTOR(S) : K.J. Lowery

It is certified that error appears in the above-indentified patent and that said Letters Patent is hereby corrected as shown below:

| COLUMN | LINE | |
|---|---|---|
| 4 | 21 | "ting" should read—ring-- |
| 4 | 23 | "ting" should read—ring-- |
| 4 | 64 | "ting" should read—ring-- |
| 5 | 10 | "beatings" should read—bearings-- |
| 5 | 22 | "ann" should read --arm-- |
| 6 | 30 | "beatings" should read --bearings-- |
| 7 | 36 | "shalt" should read --shaft-- |
| 7 | 38 | "shalt" should read --shaft-- |
| 7 | 47 | "shalt" should read --shaft-- |

UNITED STATES PATENT AND TRADEMARK OFFICE

CERTIFICATE OF CORRECTION

PATENT NO. : 5,472,592

DATED : December 5, 1995

INVENTOR(S) : K. J. Lowery

It is certified that error appears in the above-indentified patent and that said Letters Patent is hereby corrected as shown below:

| COLUMN | LINE | |
|---|---|---|
| 14 (Claim 18, line 2) | 10 | "±43%" should read --±3%-- |

Signed and Sealed this

Nineteenth Day of March, 1996

*Attest:*

Bruce Lehman

BRUCE LEHMAN

*Attesting Officer*

*Commissioner of Patents and Trademarks*